US010436497B2

(12) United States Patent
Kriegsmann

(10) Patent No.: US 10,436,497 B2
(45) Date of Patent: Oct. 8, 2019

(54) NO-FROST REFRIGERATION APPLIANCE

(71) Applicant: BSH HAUSGERAETE GMBH, Munich (DE)

(72) Inventor: Ulrich Kriegsmann, Ulm (DE)

(73) Assignee: BSH Hausgeraete GmbH, Munich (DE)

( * ) Notice: Subject to any disclaimer, the term of this patent is extended or adjusted under 35 U.S.C. 154(b) by 107 days.

(21) Appl. No.: 15/787,096

(22) Filed: Oct. 18, 2017

(65) Prior Publication Data

US 2018/0106527 A1 Apr. 19, 2018

(30) Foreign Application Priority Data

Oct. 19, 2016 (DE) ..... 10 2016 220 464

(51) Int. Cl.

| | |
|---|---|
| ***F25D 21/08*** | (2006.01) |
| ***F25D 21/00*** | (2006.01) |
| ***F25D 21/04*** | (2006.01) |
| ***F25D 23/00*** | (2006.01) |

(52) U.S. Cl.

CPC ..... *F25D 21/08* (2013.01); *F25D 21/004* (2013.01); *F25D 21/04* (2013.01); *F25D 23/006* (2013.01); *F25D 2700/10* (2013.01)

(58) Field of Classification Search

CPC ..... F25D 21/00; F25D 21/04; F25D 21/06; F25D 21/08; F25D 23/006; F25D 23/068; F25D 2400/02; F25D 2700/10

See application file for complete search history.

(56) References Cited

U.S. PATENT DOCUMENTS 5,816,054 A * 10/1998 Yoo ..... F25B 5/04 62/80

2013/0098077 A1* 4/2013 Bonet ..... F25B 5/02 62/82

* cited by examiner

*Primary Examiner* — Jonathan Bradford

(74) *Attorney, Agent, or Firm* — Laurence A. Greenberg; Werner H. Stemer; Ralph E. Locher

(57) ABSTRACT

A no-frost refrigeration appliance has an interior which is divided by a partition into an evaporator chamber and a storage chamber. The evaporator chamber accommodates an evaporator and a defrost heater. The storage chamber is cooled by the evaporator chamber. The partition and the evaporator are mutually independently attached to walls of the interior. The defrost heater is not connected to the evaporator and is fastened to the partition.

10 Claims, 3 Drawing Sheets

NO-FROST REFRIGERATION APPLIANCE

CROSS-REFERENCE TO RELATED APPLICATION

This application claims the benefit, under 35 U.S.C. § 119, of German patent application DE 10 2016 220 464.5, filed Oct. 19, 2016; the prior application is herewith incorporated by reference in its entirety.

BACKGROUND OF THE INVENTION

Field of the Invention

The present invention relates to a no-frost refrigeration appliance with an interior that is divided by a partition into an accommodating evaporator chamber and a storage chamber cooled by the evaporator chamber. The evaporator chamber of such a refrigeration appliance generally also contains, in addition to the evaporator, a defrost heater which serves to defrost the evaporator. The evaporator is fixedly brazed into a refrigerant circuit of the refrigeration appliance and is virtually impossible to remove from the finished refrigeration appliance at reasonable cost without destroying it. Repairs have therefore to be carried out in such a way that the evaporator can remain in place.

According to a conventional technique, the defrost heater is fastened to the evaporator with the assistance of plate-shaped holders that are formed with a plurality of holes, the defrost heater being inserted into one of the holes and another hole being pushed onto a tube loop projecting laterally from the evaporator. These holders permit convenient preassembly of the defrost heater to the evaporator, before they are together fitted into the interior of the refrigeration appliance. The defrost heater can be removed for repair purposes by pushing the holder down off the tube loop, but removal and in particular refitting are troublesome, since the evaporator is generally located on a poorly accessible rear wall of the interior and a side wall immediately adjacent to the tube loop obstructs reinsertion of the holder onto the tube loop.

BRIEF SUMMARY OF THE INVENTION

It is accordingly an object of the invention to provide a refrigeration appliance which overcomes the above-mentioned and other disadvantages of the heretofore-known devices and methods of this general type and in which repairs to the evaporator chamber can be carried out quickly and simply.

With the foregoing and other objects in view there is provided, in accordance with the invention, a no-frost refrigeration appliance, comprising:

a partition dividing an interior of the refrigeration appliance into an evaporator chamber and a storage chamber;

an evaporator for cooling said storage chamber and a defrost heater disposed in said evaporator chamber;

said partition and said evaporator being attached to walls of the interior independently of one another; and wherein said defrost heater is fastened to said partition and is not directly connected to said evaporator.

In other words, the objects of the invention are achieved in a no-frost refrigeration appliance with an interior which is divided by a partition into an evaporator chamber, which accommodates an evaporator and a defrost heater, and a storage chamber cooled by the evaporator chamber, the partition and the evaporator being mutually independently attached to walls of the interior, by the defrost heater not being connected to the evaporator and instead being fastened to the partition. Thanks to the possibility of premounting the defrost heater and partition outside the refrigeration appliance, the number of assemblies to be mounted in the interior and of operations which have to be carried out in the interior during assembly are not increased; insertion of the evaporator into the refrigerant circuit can even be simplified, since this can proceed prior to fitting the defrost heater and consequently without any obstruction by the latter.

The advantages of the invention are particularly effective in a refrigeration appliance in which the evaporator rests against a rear wall of the interior and against the partition which is opposite the rear wall and the defrost heater is arranged below the evaporator. This invention is, however, also applicable to a refrigeration appliance in which the evaporator is mounted below a ceiling of the interior and the partition and defrost heater extend below the evaporator.

In order to permit rapid assembly of partition and defrost heater into an assembly, a channel can be formed on the partition and the defrost heater fastened to the partition via a holder which is displaceably guided in the channel in a direction parallel to a main surface of the partition.

In order to fix the defrost heater to the partition, in particular in order to mark the position which must be adopted by the defrost heater on the partition for it to be correctly positioned relative to the evaporator once fitted in the interior, at least one latching recess may be formed on a wall of the channel, and the holder may comprise a latching projection which engages in the latching recess.

Such a channel can be formed simply and inexpensively, in particular on a partition injection molded from plastics, by forming protruding hooks on a main surface of the partition, such that a tongue of the holder rests against the main surface between the hooks and the hooks grip around the tongue on two edges parallel to the direction of displacement.

The latching recess may then in particular be a cutout or a hole in the part of the main surface located between the hooks.

In accordance with an added feature of the invention, the holder is formed in one piece from a flat material, preferably from sheet metal.

In accordance with an additional feature of the invention, the latching projection can be embossed in the flat material.

In a manner known per se, the holder may comprise a carrier plate with a hole into which the defrost heater is inserted. So that the tongue of the holder can engage compactly between the evaporator and the partition, the tongue and the carrier plate should lie in planes which intersect along a plane parallel to the direction of displacement of the holder.

For the purpose of saving space, it is furthermore of assistance for the tongue and the carrier plate not to be connected directly via an edge parallel to the direction of displacement, but instead indirectly via an intermediate plate which is bent out from an edge of the tongue oriented transversely of the direction of displacement.

A temperature sensor, which allows the defrost heater to be switched off in the event of overheating, in particular a thermal fuse, may be mounted on the holder, preferably on the above-mentioned intermediate plate thereof.

Other features which are considered as characteristic for the invention are set forth in the appended claims.

Although the invention is illustrated and described herein as embodied in a no-frost refrigeration appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

DETAILED DESCRIPTION OF THE INVENTION

Figure 1:
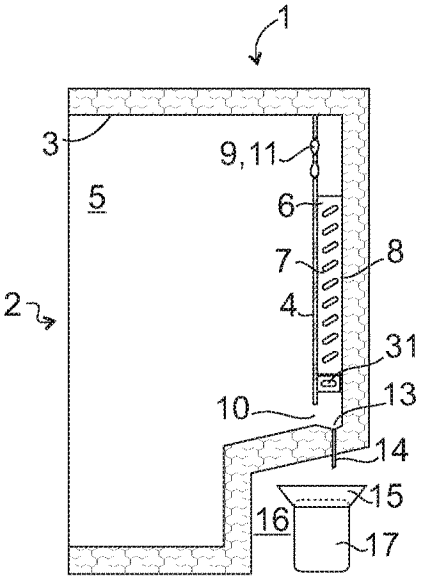
FIG. 1 shows a schematic section through a refrigeration appliance according to the invention.

Referring now to the figures of the drawing in detail and first, particularly, to FIG. 1 thereof, there is shown a schematic section through a housing box 1 (also referred to as a carcass 1) of a domestic refrigeration appliance taken along a section plane extending vertically and in the depth direction. An interior 2 of the housing box 1 is defined by an inner liner 3 thermoformed in one piece from plastics. A partition 4 suspended on side walls of the inner liner 3 subdivides the interior 2 into a storage chamber 5 and an evaporator chamber 6. An evaporator 7 is mounted in the evaporator chamber 6. Slats of the evaporator 7 extend parallel to the section plane, such that air can circulate between them in the vertical direction, and they rest each with a longitudinal edge against a rear wall 8 of the inner liner or against the partition 4. The evaporator chamber 6 and storage chamber 5 communicate via two passages 9, 10 in the partition 4. A fan 11 is arranged at one of these to drive air circulation through the evaporator chamber 6 and air exchange with the storage chamber 5.

Below the evaporator 7, a defrost heater 31 is mounted in the evaporator chamber 6 in order to defrost the evaporator 7 as required. In the inner liner 3, below the defrost heater 31, there is a condensate drain groove 13 recessed at the bottom of the rear wall 8. From a lowest point of the condensate drain groove 13, a drain line 14 extends through a thermal insulation layer of the housing box 1 to an evaporation pan 15 which, in a manner known per se, is mounted in a machine compartment 16 in thermal contact with a compressor 17 accommodated therein.

Figure 2:
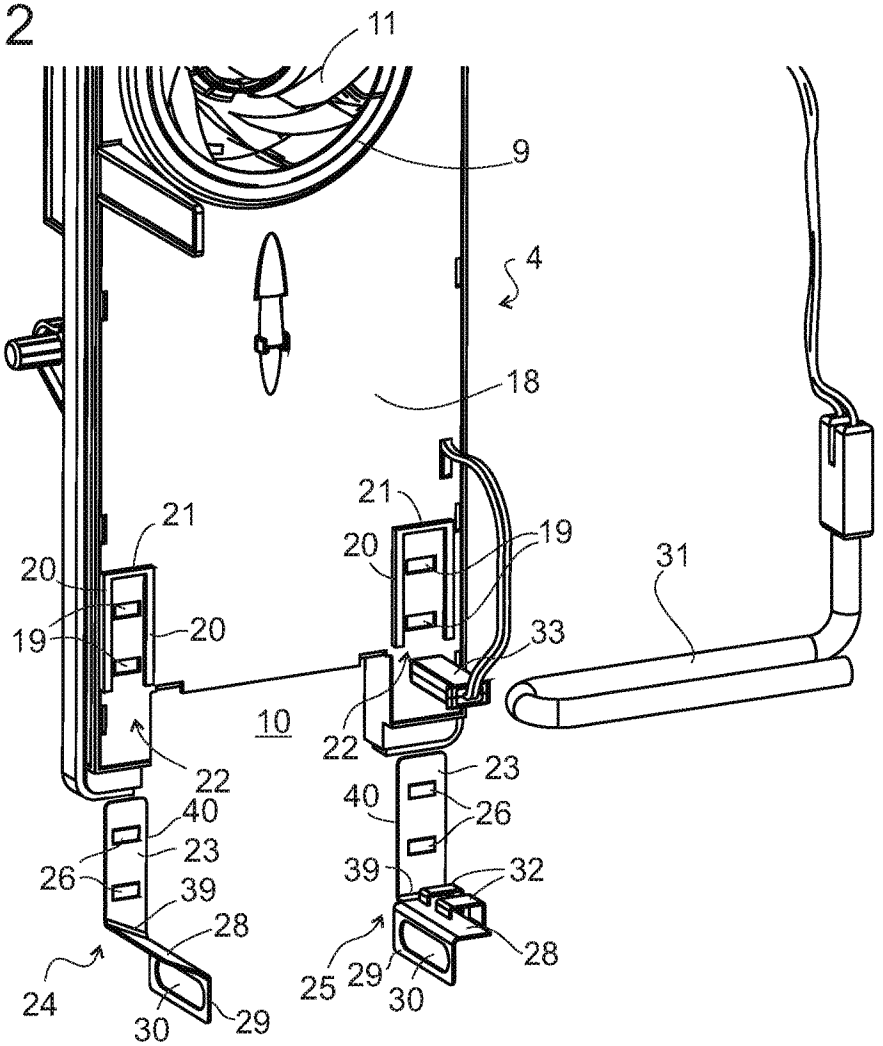
FIG. 2 shows a perspective view of a defrost heater, a partition and two holders to be mounted on the partition.

FIG. 2 shows the partition 4 in a perspective view, wherein, in the completely mounted refrigeration appliance, the main surface 18 thereof which faces the evaporator chamber is facing towards the observer in the view of FIG. 2. The partition 4 is a substantially rectangular plate. The circular passage 9 located in the upper part of the partition 4 and which accommodates the fan 11 is shown only in part. The passage 10 is an open-edged cutout at a lower edge of the partition 4.

In the lower part of the partition 4, the main surface 18 is planar with the exception of latching recesses 19, here two on each side of the passage 10, and of hooks 20, 21 which are grouped around the latching recesses 19, in order to form in each case a downwardly open channel 22 into which a flat tongue 23 of a holder 24, 25, which is shaped from a sheet metal blank and described below in greater detail, can be inserted. The hooks 20 extend in a vertical direction and define the channel 22 in the lateral direction; together with the surface 18, they in each case form mutually facing grooves which accommodate the lateral edges of the tongue 23; the hook 21 at the upper end of the channel 22 forms a limit stop which upwardly limits the freedom of movement of the tongue 23.

Figure 4:
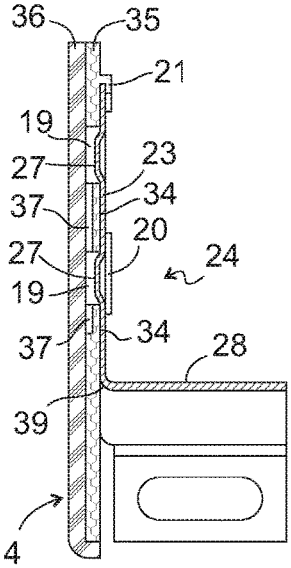
FIG. 4 shows a section through a lower part of the partition and one of the holders mounted thereon.

A plurality of protrusions 26 are embossed in the tongue 23 and form latching projections 27 on the side remote from the observer (see FIG. 4). By engaging in the latching recesses 19, these define a target position up to which the tongues 23 are to be inserted into the channels 19.

An intermediate plate 28 is bent out at a lower edge 39 of the tongue 23. A crease zone between tongue 23 and intermediate plate 28 extends transversely of the direction of displacement of the tongues 23 in the channels 19; it may, as in the case of the holder 25, be oriented orthogonally to the direction of displacement or, as in the case of holder 24, be oriented at an angle differing from a right angle, such that the intermediate plate 28 slopes towards the passage 10.

A carrier plate 29 is in each case bent out at an edge of the intermediate plates 28 of the two holders 24, 25 which faces the passage 10. A large-area hole 30 is punched out of each of the carrier plates 29, the hole being provided for insertion of a defrost heater 31. The carrier plate 29 and tongue 23 of the holder extend in mutually orthogonal planes which intersect along a line which approximately coincides with one of the two longitudinal edges 40 of the tongue 23.

At the edge of an intermediate plate 28 remote from the passage 10, at least one hook or a clip 32 is formed which is provided to clamp a temperature sensor 33 firmly against the intermediate plate 28. The temperature sensor 33 here acts as a thermal fuse which turns off the defrost heater 31 in the event of an upper temperature limit being exceeded.

Figure 3:
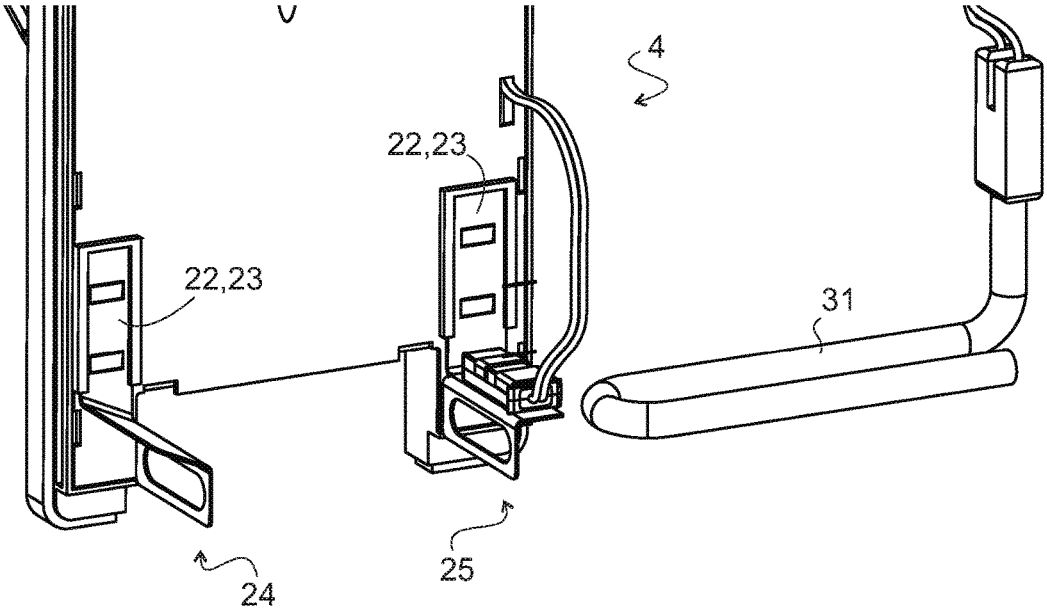
FIG. 3 shows the partition with mounted holders.

In FIG. 3, the holders 24, 25 are mounted on the partition. The tongues 23 thereof are inserted into the channels 22 of the partition 4 and, as is apparent in FIG. 4 from a longitudinal section through the tongue 23 of the holder 24, the latching projections 27 engage into the latching recesses 19 of the partition 4. The latching projections 27 could be cut away from the tongues 23 in order to facilitate resilient yielding, but in the case shown here are instead materially bonded all around with the tongue 23, in order to create continuous transitions to the surrounding tongue 23 which are free of sharp edges on both the upper and the lower edges of the latching projections 27 which allow the tongue 23 to be inserted into and withdrawn from the channel 19 by applying an approximately identical force. The elastic deformation which is required for the latching projections 27 to reach the latching recesses 19 and leave them again here occurs on sides of the partition 4, in particular in the surfaces 34 thereof extending between the mutually opposing hooks 20.

As shown in FIG. 4, the partition 4 is of two-layer construction, with an inner layer 35 facing the evaporator chamber 6 and an outer layer 36 facing the storage chamber 5. It is accordingly possible to punch the latching recesses 19 as holes in the inner layer 35 while presenting the user with an outer layer 36 with a regular surface without holes.

If desired, the thickness of the inner layer 35 may be reduced in the region of the channel 19 in order to create cavities 37 into which the wall face 34 can be deflected under the pressure of the latching projections 27 during insertion or withdrawal of the tongue 23.

Figure 5:
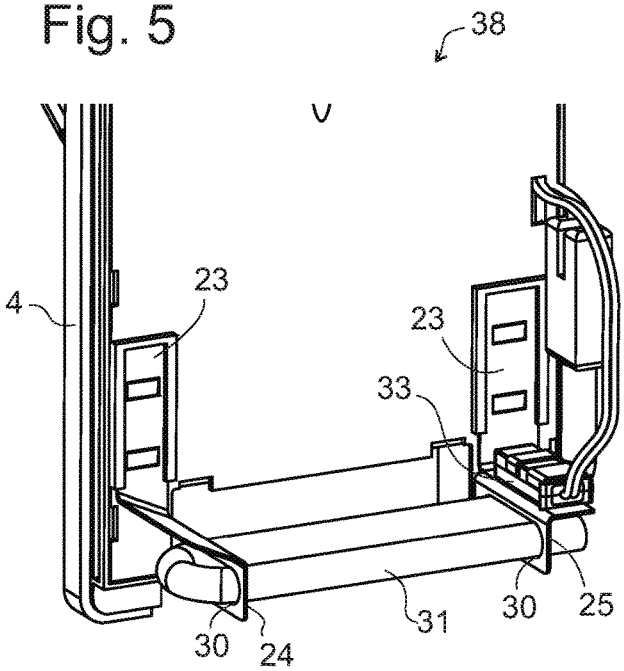
FIG. 5 shows the partition with the defrost heater inserted into the holder.
Figure 6:
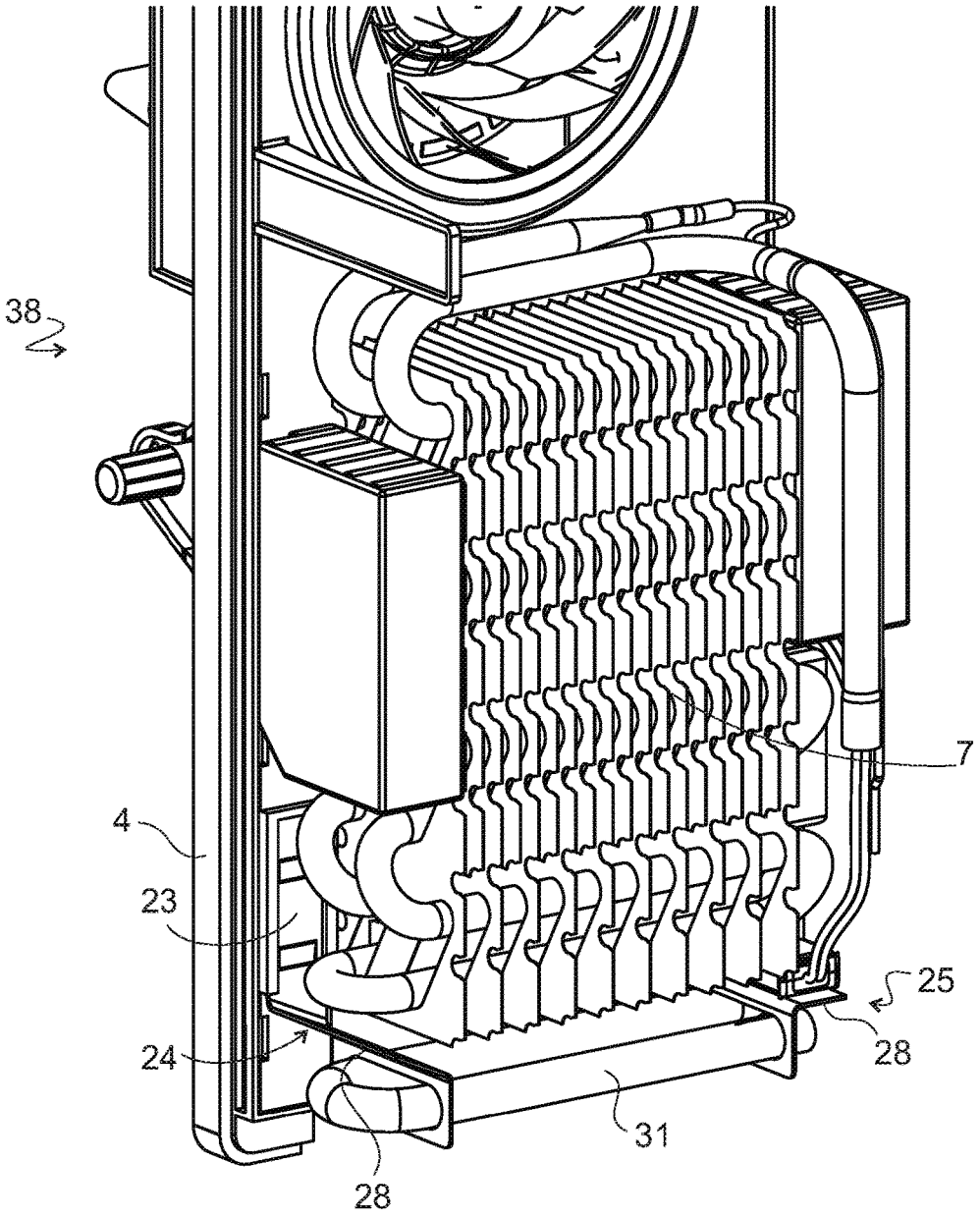
FIG. 6 shows the assembly formed by partition, holder and defrost heater placed on the evaporator.

As shown in FIG. 5, the defrost heater 31 is also inserted into the holes 30 of the holders 24, 25. The resultant assembly 38 is mounted in the inner liner 3 after the evaporator 7. FIG. 6 shows the consequent arrangement of the assembly 38 relative to the evaporator 7 in a view from the same perspective as that in FIGS. 2, 3 and 5. The tongues 23 of the holders 24, 25 find space in a narrow gap between the partition 4 and the evaporator 7, such that the intermediate plates 28 come to rest directly below the evaporator 7 and the defrost heater 31 is also closely adjacent the evaporator 7 and is capable of heating the latter efficiently.

If the partition 4 has to be removed for repair purposes, the remaining components of the assembly 38 are removed therewith from the interior. The defrost heater 31, the temperature sensor 33 and the fan are thus freely accessible from all sides and can be conveniently examined and, if necessary, repaired or replaced.

The following is a summary list of reference numerals and the corresponding structure used in the above description of the invention:

1 housing box, carcass
2 Interior
3 Inner liner
4 Partition
5 Storage chamber
6 Evaporator chamber
7 Evaporator
8 Rear wall
9 Passage
9 Passage
11 Fan
13 Condensate drain groove
14 Drain line
15 Evaporation pan
16 Machine compartment
17 Compressor
18 Main surface
19 Latching recess
20 Hook
21 Hook
22 Channel
23 Tongue
24 Holder
25 Holder
26 Protrusion
27 Latching projection
28 Intermediate plate
29 Carrier plate
30 Hole
31 Defrost heater
32 Clip
33 Temperature sensor
34 Surface
35 Inner layer
36 Outer layer
37 Cavity
38 Assembly
39 Lower edge
40 Longitudinal edge

The invention claimed is:

1. A no-frost refrigeration appliance, comprising:

a partition dividing an interior of the refrigeration appliance into an evaporator chamber and a storage chamber;

an evaporator for cooling said storage chamber and a defrost heater disposed in said evaporator chamber;

said partition and said evaporator being attached to walls of the interior independently of one another; and wherein a channel is formed on said partition and said defrost heater is fastened to said partition via a holder that is displaceably guided in said channel in a direction parallel to a main surface of said partition.

2. The no-frost refrigeration appliance according to claim 1, wherein said evaporator rests against a rear wall of the interior and against said partition which is opposite the rear wall and said defrost heater is arranged below said evaporator.

3. The no-frost refrigeration appliance according to claim 1, wherein at least one latching recess is formed on a wall of said channel and said holder has a latching projection configured to engage in said latching recess.

4. The no-frost refrigeration appliance according to claim 1, wherein said channel is defined by a main surface of said partition and by hooks protruding out from the main surface which grip around a tongue of said holder on two edges parallel to the direction of displacement.

5. The no-frost refrigeration appliance according to claim 1, wherein said holder is formed in one piece from flat material.

6. The no-frost refrigeration appliance according to claim 5, wherein said holder is formed in one piece from sheet metal.

7. The no-frost refrigeration appliance according to claim 5, wherein the latching projection is embossed in the flat material.

8. The no-frost refrigeration appliance according to claim 5, wherein said holder is formed with a tongue, which engages between said evaporator and said partition, and a carrier plate, wherein said defrost heater is inserted into a hole formed in said carrier plate and said tongue and said carrier plate lie in planes which intersect along a line parallel to a direction of displacement of said holder.

9. The no-frost refrigeration appliance according to claim 8, which comprises an intermediate plate which is bent out from an edge of said tongue oriented transversely of the direction of displacement, and wherein said tongue and said carrier plate are connected via said intermediate plate.

10. The no-frost refrigeration appliance according to claim 1, which comprises a temperature sensor mounted on said holder.

* * * * *